US008789607B2

(12) United States Patent
Jelsma et al.

(10) Patent No.: US 8,789,607 B2
(45) Date of Patent: Jul. 29, 2014

(54) METHOD AND APPARATUS FOR SUBSEA WELLHEAD ENCAPSULATION

(76) Inventors: Henk H. Jelsma, Spring, TX (US); Jean Claude Bret, Luxembourg (LU); Heiner P. T. Hartwich, Kopstal (LU)

( * ) Notice: Subject to any disclaimer, the term of this patent is extended or adjusted under 35 U.S.C. 154(b) by 16 days.

(21) Appl. No.: 13/385,992

(22) Filed: Mar. 19, 2012

(65) Prior Publication Data

US 2013/0008665 A1 Jan. 10, 2013

Related U.S. Application Data

(60) Provisional application No. 61/465,563, filed on Mar. 21, 2011.

(51) Int. Cl.
*E21B 43/01* (2006.01)

(52) U.S. Cl.
CPC ..... *E21B 43/0122* (2013.01)
USPC ..... 166/363; 166/79.1; 166/93.1

(58) Field of Classification Search
CPC ..... E21B 43/0122
USPC ..... 166/363, 351, 364, 373, 79.1, 93.1, 166/94.1, 96.1, 97.1, 75.13; 405/60
See application file for complete search history.

(56) References Cited

U.S. PATENT DOCUMENTS 858,321 A * 6/1907 Auchu ..... 166/93.1
1,520,288 A * 12/1924 Featherstone ..... 169/49
1,859,606 A * 5/1932 Sievern et al. ..... 166/79.1
1,978,377 A * 10/1934 Walker ..... 166/92.1
2,532,341 A * 12/1950 Shannon ..... 166/96.1
3,247,672 A * 4/1966 Johnson ..... 405/210
3,602,301 A * 8/1971 James ..... 166/338
3,674,150 A * 7/1972 Lejeune ..... 210/245
3,719,048 A * 3/1973 Arne et al. ..... 405/205
4,283,159 A * 8/1981 Johnson et al. ..... 405/60
4,318,442 A * 3/1982 Lunde et al. ..... 166/357
4,323,118 A * 4/1982 Bergmann ..... 166/96.1
4,382,716 A * 5/1983 Miller ..... 405/60
4,456,071 A * 6/1984 Milgram ..... 166/356
4,568,220 A * 2/1986 Hickey ..... 405/60
5,050,680 A * 9/1991 Diehl et al. ..... 166/356
5,150,751 A * 9/1992 Burton et al. ..... 166/81.1
5,154,234 A * 10/1992 Carrico ..... 169/46
5,170,846 A * 12/1992 Hope ..... 166/379
5,394,939 A * 3/1995 Walker ..... 166/81.1
8,016,030 B1 * 9/2011 Prado Garcia ..... 166/75.13
8,025,103 B1 * 9/2011 Wolinsky ..... 166/364
8,186,443 B2 * 5/2012 Wolinsky ..... 166/364
8,196,665 B2 * 6/2012 Wolinsky ..... 166/356
8,322,437 B2 * 12/2012 Brey ..... 166/363
8,434,558 B2 * 5/2013 Swanson et al. ..... 166/368
8,555,980 B1 * 10/2013 Powell ..... 166/363
2011/0274493 A1 * 11/2011 Cutts ..... 405/60
2011/0297386 A1 * 12/2011 Huotari ..... 166/341

(Continued)

*Primary Examiner* — Matthew Buck

(57) ABSTRACT

A BOP stack encapsulation system has dual partially hemispherical dome sections which are each supported and guided for linear movement to open and closed positions relative to base plate. The dual containment domes are moved from open positions to closed and hermetically sealed positions about a BOP stack responsive to sensing BOP leakage or a dangerous pressure condition and are controllable from a remote location. When both containment domes are closed they develop concentrically arranged dual hermetically sealed spaces that enclose the BOP stack and capture any leaked fluid and pressure. Captured well fluid constituents can be bled from the internal spaces of the concentric encapsulation domes as desired.

17 Claims, 6 Drawing Sheets

(56) References Cited

U.S. PATENT DOCUMENTS

| | | | | |
|---|---|---|---|---|
| 2011/0297396 | A1* | 12/2011 | Hendel et al. | 166/379 |
| 2011/0315393 | A1* | 12/2011 | Wolinsky | 166/363 |
| 2011/0315395 | A1* | 12/2011 | Wolinsky | 166/363 |
| 2011/0315396 | A1* | 12/2011 | Wolinsky | 166/363 |
| 2012/0024535 | A1* | 2/2012 | Lieske, II | 166/363 |
| 2012/0045285 | A1* | 2/2012 | Hansen | 405/203 |
| 2012/0160509 | A1* | 6/2012 | Caldwell et al. | 166/363 |
| 2012/0186822 | A1* | 7/2012 | Mahajan et al. | 166/364 |
| 2012/0241160 | A1* | 9/2012 | Spacek | 166/338 |

* cited by examiner

METHOD AND APPARATUS FOR SUBSEA WELLHEAD ENCAPSULATION

RELATED PATENT APPLICATION

Applicants hereby claim the benefit of U.S. Provisional Patent Application No. 61/465,563 filed on Mar. 21, 2011 by Henk H. Jelsma, Jean Claude Bret, and Heiner P. T. Hartwich, and entitled "Seabottom Encapsulating System For Underwater Blowout Containment", which Provisional Patent Application is incorporated by reference herein for all purposes.

BACKGROUND OF THE INVENTION

Field of the Invention

The present invention relates generally to the drilling, completion and production of subsea wells for petroleum products such as natural gas and crude oil. The present invention concerns a method and apparatus for containment of any fluids/gas and other forms of escaped material from a seafloor well head and/or blowout preventer (BOP) system by the use of a hermetically sealable dual encapsulating system that allows for bleed or circulation through existing riser connections. More particularly, the present invention concerns an encapsulation system that is installed when well drilling is initiated and which is normally maintained in an open or retracted condition, but is closed about a subsea wellhead/BOP installation located at the seabottom responsive to detection of an excessive pressure condition or detection of other well, wellhead or formation parameters that provide an indication of actual or potential well leakage or blowout at the wellhead.

SUMMARY OF THE INVENTION

It is a principal feature of the present invention to provide a novel containment system for subsea wellheads which is normally open to permit access to a subsea by equipment or personnel and which will be closed in response to detection of design parameters to provide a pressure containing encapsulation of the wellhead to prevent or minimize the effect of a well blowout;

It is another feature of the present invention to provide a novel containment system for subsea wellheads which has a valving capability for permitting release of well pressure upon closing and then selectively or sequentially closing its valving system to ensure containment and to minimize the mechanical stresses that otherwise may occur upon rapid closure of the containment system under well pressure.

It is also a feature of the present invention to provide a novel containment system for which is capable of containing any fluids/gas and other forms of escaped material from seafloor wellheads and blowout preventer (BOP) systems by the use of hermetically sealed dual encapsulating system that allows for bleed of and circulation through existing riser connections.

It is an even further of the present invention to provide a novel wellhead leakage or blowout containment system that employs a concrete base that is an extension of the typical seafloor base plate arrangement and provides for hydraulic, pneumatic or electric powered movement of encapsulation ¼ spheres or wedges along guide members or tracks that are mounted to the base plate or drilling template.

It is another feature of the present invention to provide a novel wellhead and BOP stack containment system that can be controlled from a remote location and/or which can be designed for automatic control in response to the sensing of undesirable wellhead and BOP conditions.

It is also a feature of the present invention to provide a novel containment system that is designed for pressure build-up control, such as by means of selectively or automatically operated valves, thus permitting gradual pressure increase with one or more sealed spaces to minimize the potential for structural failure of pressure containing components by the shock and stress of sudden pressure increase.

It is a feature of the present invention to provide a novel wellhead and BOP containment system that is designed to permit controlled bleeding of contained pressure so that petroleum constituents are prevented from being released into the seawater in the event of leakage.

Briefly, the various objects and features of the present invention are realized through the provision of a base plate that is an extension of a standard base plate for well drilling and which has guide members such as tracks mounted thereto. Substantially ¼ spherical inner and outer encapsulating closure members are mounted for movement along the guide members or tracks and each have rubber or rubber-like sealing members that establish hermetic sealing with the base plate. The encapsulating closure members each have seal joint structure including sealing components that establish high pressure resisting sealing with one another and with risers that extend from the wellhead or BOP stack when the encapsulating closure members are hydraulically, pneumatically or electrically moved from their normal retracted positions to closed and hermetically sealed condition.

The inner and outer encapsulating closure members are moved to closed positions sequentially and the inner encapsulating closure members are perforated to permit leakage during closing movement so that leakage pressure will not prevent complete closure and sealing of the enclosures to one another. The perforations will be selectively closed and sealed after the inner encapsulating enclosure has been closed and sealed. Closure of the perforation can be accomplished by valve members, which can be controlled remotely or can be set for automatic closure at selected pressure ranges. The valves permit gradual increase of pressure within the closed and sealed inner encapsulating enclosure and ensure that the integrity of the wall structure will not be over-stressed or ruptured by sudden increase in pressure.

After the inner encapsulating closure mechanism has been closed and sealed and its valves have closed the perforations the outer encapsulating closure mechanism will be moved from its retracted position to its closed and sealed condition, thus establishing a dual pressure containment system to maintain a safe condition of the leaking wellhead or BOP stack system until the well can be serviced and restored to a safe condition.

The present invention concerns a method to contain any fluids, gases or mixtures thereof and any other forms of escaped material from seafloor wellheads and BOP systems by the use of a hermetically sealable dual encapsulating system that allows for bleed of and circulation through existing wellhead riser connections.

The system of the present invention uses a concrete base that is an extension of the typical seafloor base plate arrangement. The quarter spheres or wedges of the encapsulation system are mounted on the base plate and can move along guides. This quarter sphere or wedge movement is hydraulically, pneumatically or electrically controlled from the surface and from a remote location.

System designed to be controlled multiple ways, by surface from the production platform of drilling unit, from remote location such as helicopters, ships, shore location, etc. or automatically when extraordinary events trigger the set mechanism on the sea floor. The BOP encapsulation system is designed to contain pressures and leaks of any type of fluids and hydrocarbons that can affect the environment. Security domes close and seal over the existing blow-out prevention (typical) stacks and form a total encapsulation of all evading fluids and gases which can then be "drained" from the primary and secondary encapsulation domes by built-in pressure relief and escape devices.

Briefly, a riser pipe (1) connects the existing BOP stack (11) that comprises the spherical (13) and the Ram type BOP (12) via a ball joint (14) to surface. This is the basic set-up for most offshore well drilling operations. This can vary, and it is intended that the invention will cover all possible sea bottom combinations as the size of the encapsulation system can vary according to needs and design.

The encapsulation system consists of two concentrically arranged substantially hemispherical fluid and pressure containment domes, a primary dome (4) and a secondary dome (6). These domes are each defined by a pair of dome quarter sections that are laterally moveable relative to one another to an open condition permitting well drilling operations and a closed and sealed condition establishing sealed encapsulation of the BOP unit and sealing with the riser pipe. The quarter hemispherical dome sections of the primary dome are linearly moveable by hydraulic rams and are guided during movement. The quarter hemispherical sections of the secondary are guided during linear movement by spaced guide and actuation rails that are fixed to the drilling template or to extensions of the template. Both domes have a top sealing elements that will close around respective primary and secondary sealing skirts that are mounted to the riser pipe. These seals each have pressure responsive positive sealing capability . . . they increase sealing power when the internal pressure increases. Seals cover the entire range of contact points of both domes. The bottom seals on the secondary dome, (16) and the face seals (19) as well as the bottom seals on the primary dome (17) and the face seals of the primary dome (18) are all of the same positive seal capability and are pressed together for the outer or secondary dome by a rail traction system (9) and for the primary dome by a hydraulic arm pulling system (10). Upon activating the primary dome (4) will move to close once activated by one of the methods available. When moving to close the pressure escape gates (8) on this dome remain open until such time that the primary dome is fully closed. At this point the pressure escape gates (8) will close to trap the increasing pressure. As the pressure increases, the seals will also expand and fully contain the escaping fluids and gases. Once the primary dome (4) is in place the secondary dome (6) closes over the primary dome to ensure back-up safety and full hermetic sealing by means of the various positive seals (7, 19 and 16). With the system now in control of the events of the blow out or fluid escape, thru the well places various pressure relief valves and piping system (20 and 21) the pressure can now be controlled and bled off to surface of drained in a receptacle on surface.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

Figure 1:
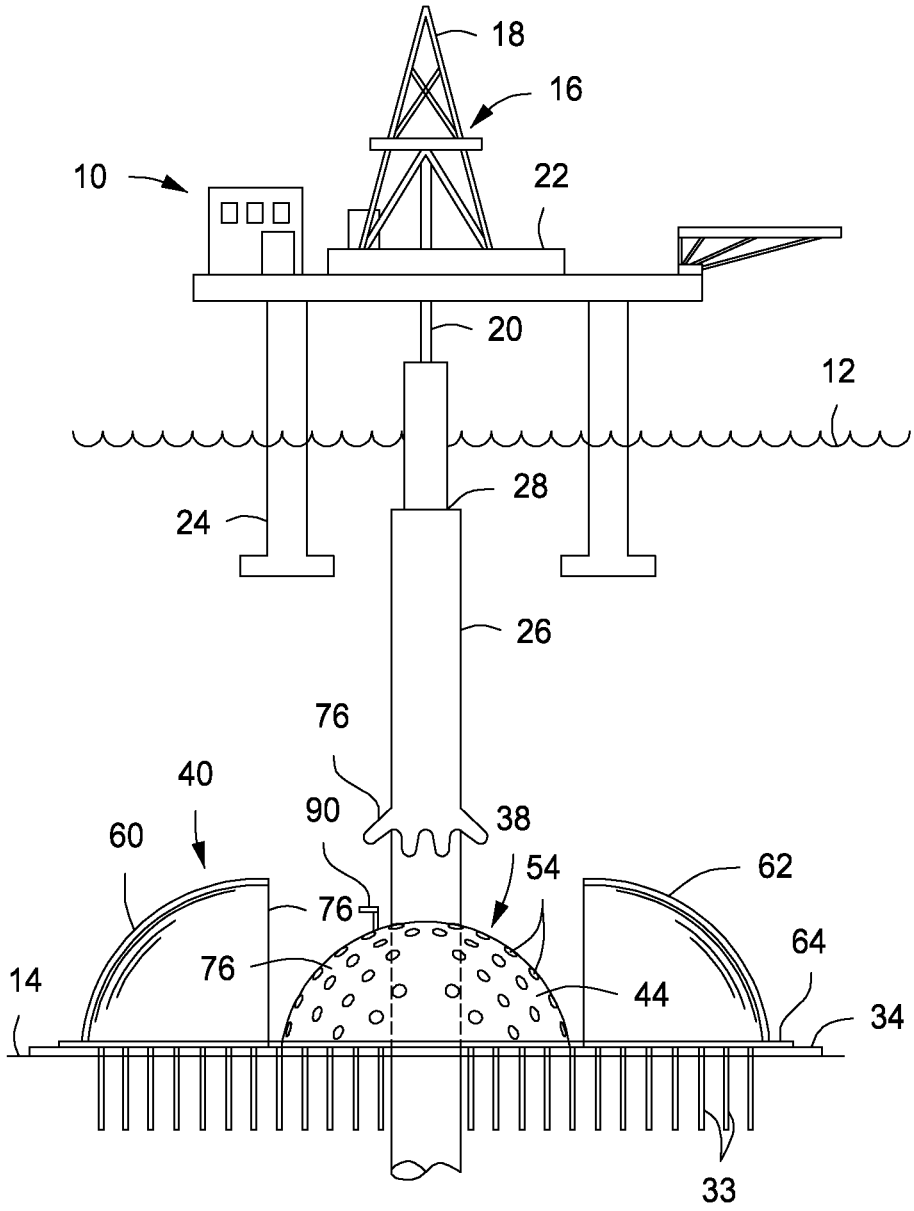
Figure 2:
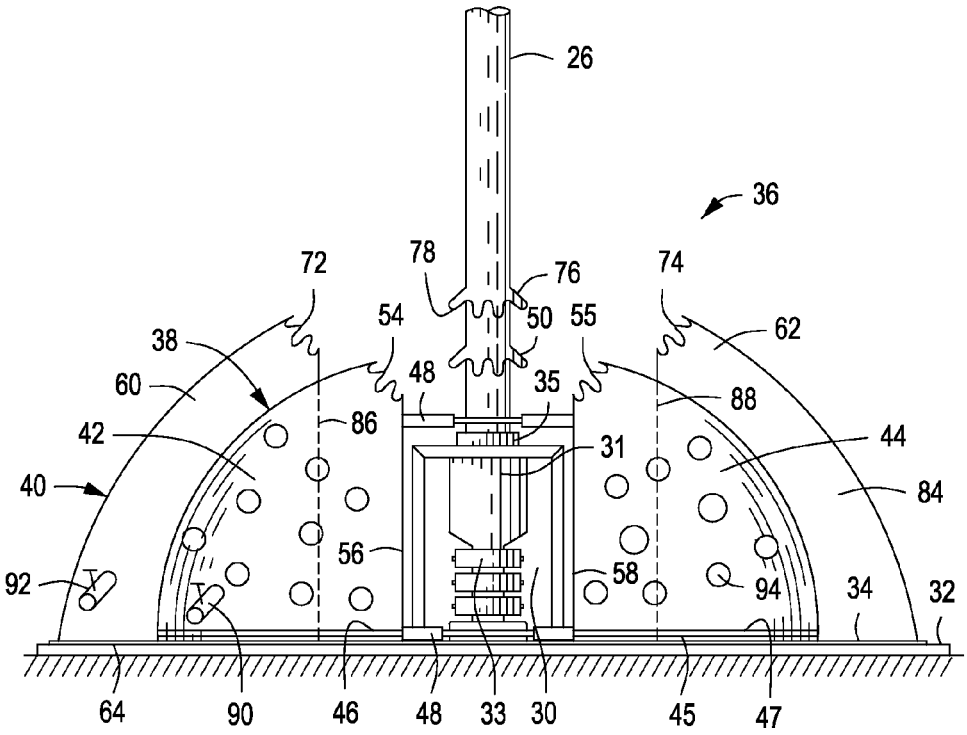
Figure 3:
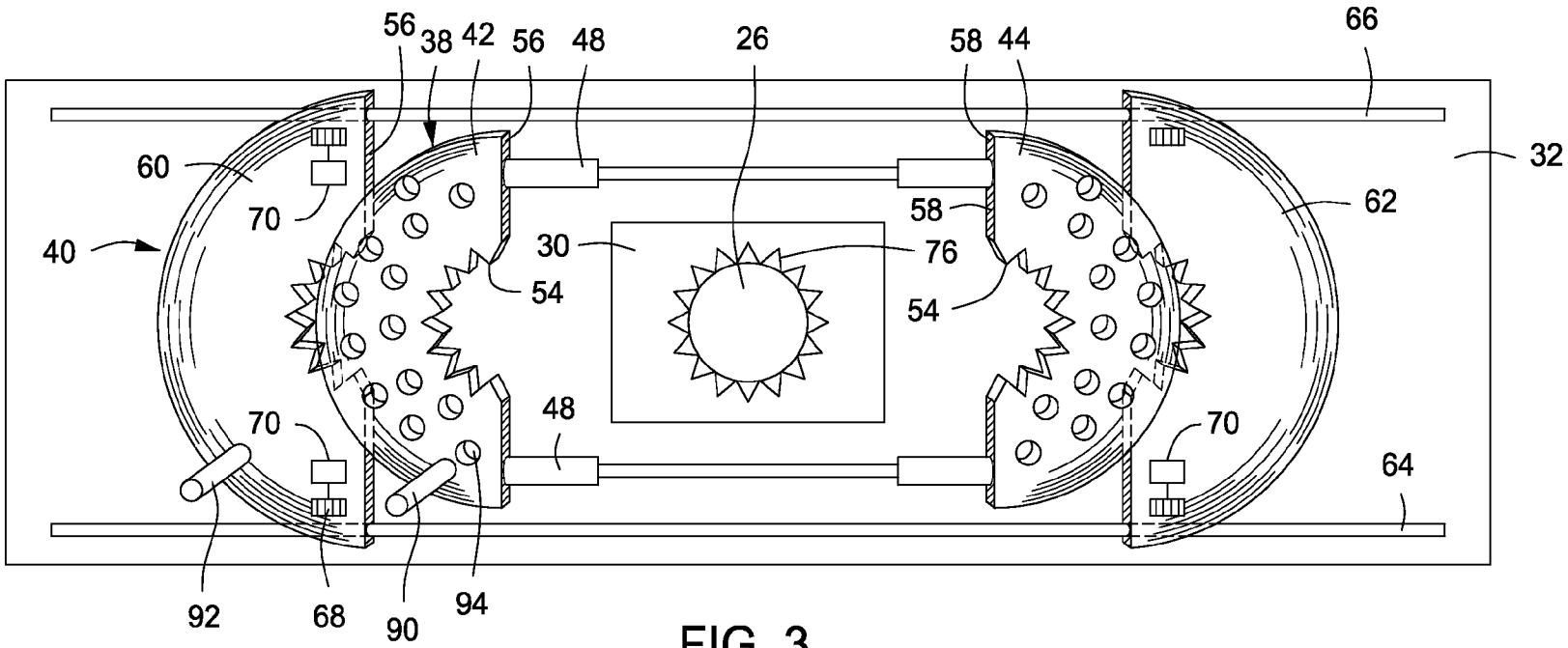
Figure 4:
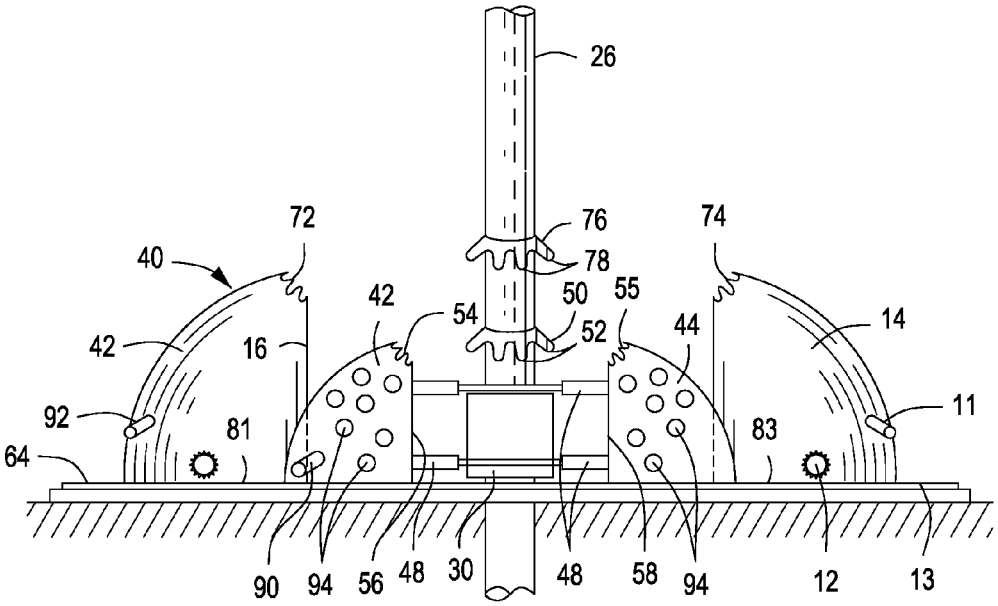
Figure 5:
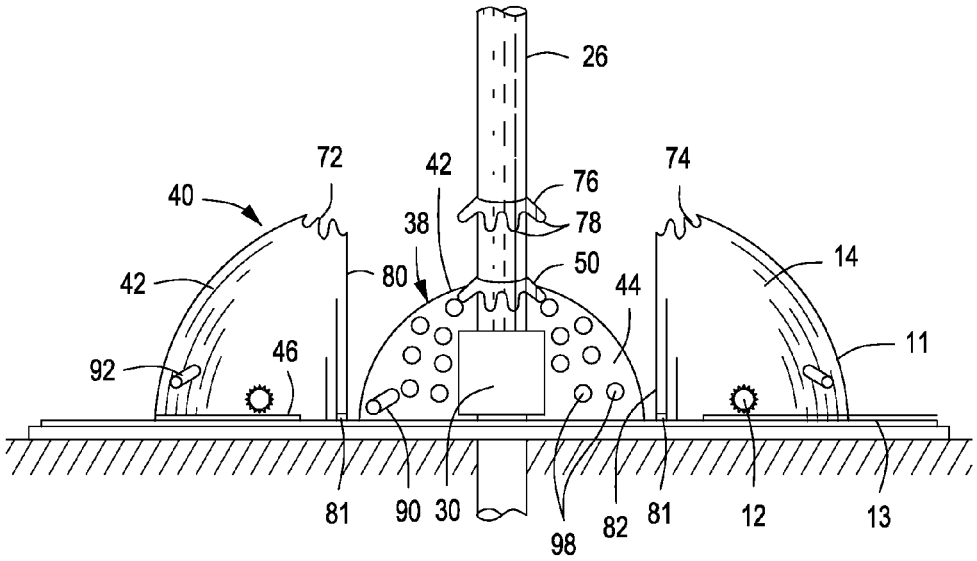
Figure 6:
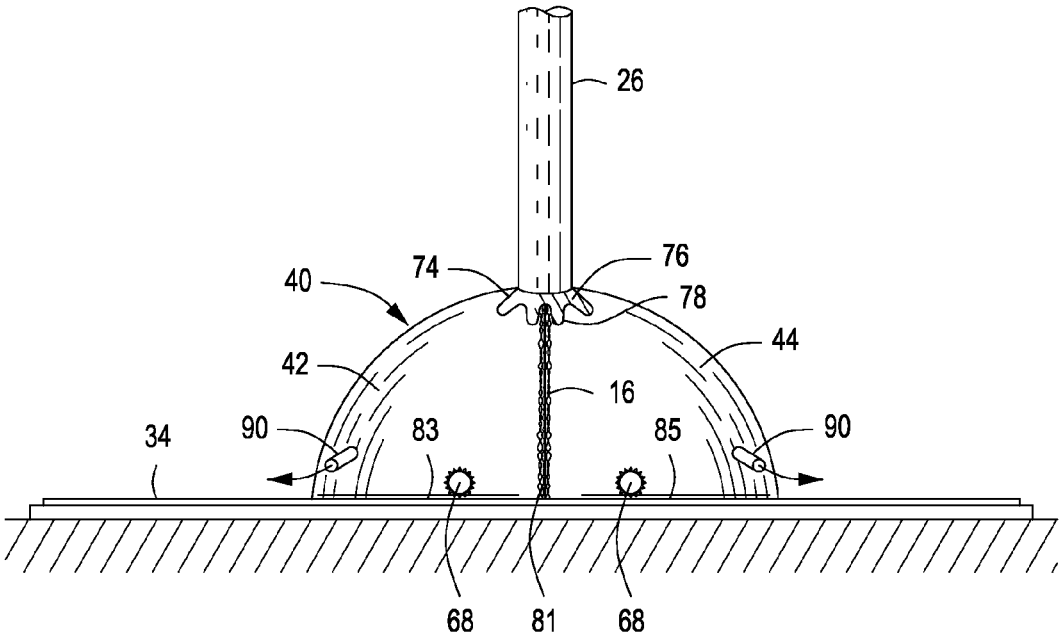
Figure 7:
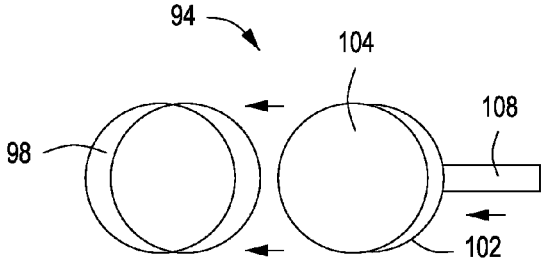
Figure 8:
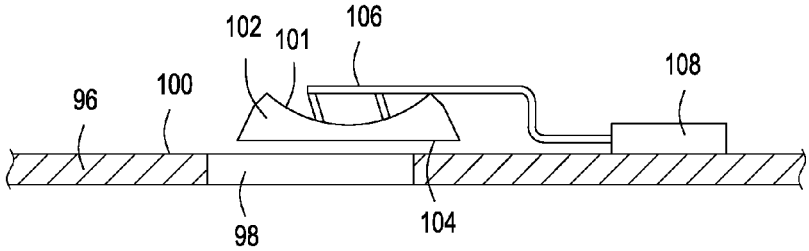
Figure 9:
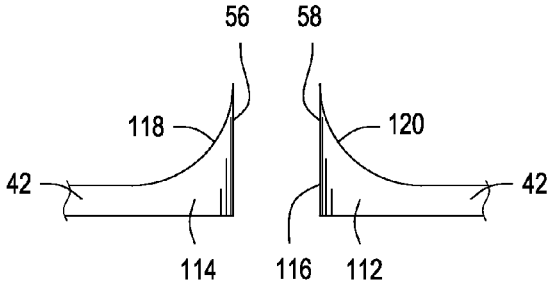
Figure 10:
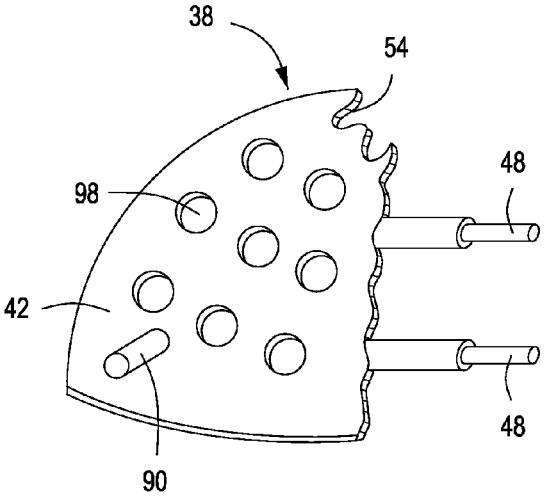
Figure 11:
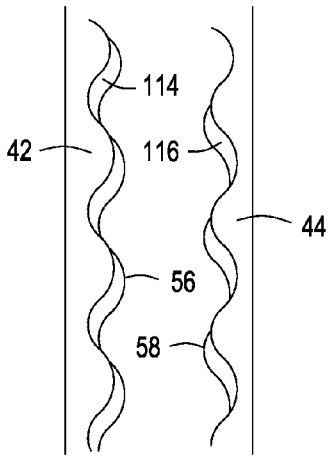

FIG. 1 is an elevation view showing a semi-submersible well drilling platform situated relative to the surface of a body of water, showing a tubular drilling column through which drill pipe is extended and further showing a BOP stack situated relative to the sea floor and an encapsulation system for the BOP stack which has sections that are moveable to open and closed positions and embodies the principles of the present invention;

FIG. 2 is another elevation view illustrating the BOP/wellhead encapsulation system with its sections retracted to the open positions thereof, as would be the case during well drilling activity;

FIG. 3 is a top plan view showing the retracted positions of the inner and outer spherical components of the encapsulation system relative to guide tracks of the drilling template and representing the open condition of the encapsulation system and further showing a BOP stack;

FIG. 4 is an elevation view showing the retracted positions of the primary and secondary dome sections of the BOP encapsulation system when the encapsulation system is open to permit well drilling activity;

FIG. 5 is an elevation view showing the primary, spherical BOP encapsulating dome of the encapsulation system in the closed and sealed condition thereof and showing the secondary spherical encapsulating dome in its open or retracted condition;

FIG. 6 is an elevation view showing the completely closed and sealed condition of the primary and secondary domes of the BOP encapsulation system, such as would be the case when the encapsulation system is closed in response to detection of an actual or potential condition of leakage or is closed for testing;

FIG. 7 is an illustration showing an escape gate of either of the sections of the primary BOP encapsulation dome and further showing an escape gate closing seal cup that is located at a partially open position relative to the escape gate opening and is moveable to a closing and sealing position relative to the escape gate;

FIG. 8 is a fragmentary sectional view of a section of the primary dome of the BOP encapsulation system of the present invention showing another view with the closing seal cup located at a partially open position relative to the escape gate opening and being moveable to a closing and sealing position relative to the escape gate;

FIG. 9 is a fragmentary sectional top view illustration showing a fluid pressure energized face sealing arrangement that is employed by both the primary and secondary \BOP encapsulation domes;

FIG. 10 is a side elevation view illustrating a hemispherical section of the primary BOP encapsulation dome and showing various features thereof, including pressure bleed gates, pressure enhanced face seal geometry and riser sealing skirt seal geometry of the primary dome section; and FIG. 11 is a partial elevation view showing the undulating seal geometry of the face sealing sections that is employed by both the primary and secondary BOP encapsulation domes of the present invention.

DETAILED DESCRIPTION OF PREFERRED EMBODIMENT

Referring now to the drawings and first to FIG. 1, a semi-submersible well drilling platform is shown generally at 10 in relation to the surface 12 of a body of water that is referred to herein as the sea. Obviously, the body of water may have the form of a lake of fresh water and, if desired, the drilling platform may take the form of a platform having support legs and structure that rest on the sea bed 14, instead of being a semi-submersible drilling platform as shown. A drilling rig shown generally at 16 is shown with a derrick or drilling mast 18 and with drill pipe 20 extending downwardly through the platform floor or deck 22. Buoyancy legs 24 extend downwardly from the platform floor or deck 22 and provide for support and stability of the platform relative to the sea surface 12.

The drill pipe 20 extends through a pipe column or riser pipe structure 26 having a slip joint 28 that accommodates any vertical movement of the platform by wave action of the sea surface. The column or riser extends downwardly to a blowout preventer (BOP) stack 30 that is anchored at or near the sea bed 14, typically by being mounted to a base plate or drilling template 32 that is anchored to the sea bed by means of any suitable anchor devices. The drilling template 32 is typically composed of reinforced concrete; however, it may be composed of a metal, such as steel, a composite of concrete and steel or other suitable materials as desired. Basically, the drilling template is in the form of a plate-like structure defining a plurality of well drilling locations and having a generally planar upper surface 34. A plurality of anchor members 33 extend through openings in the base plate and penetrate a sufficient depth into the formation material of the sea floor to secure the base plate or drilling template against movement. Should an extraordinary event be detected, such as leakage of the BOP unit, an actual or potential well blowout, or any unusual well anomaly, it is desirable to provide an effective means for quickly and effectively encapsulating the BOP unit and developing a positive seal with the riser pipe 26 to prevent the leakage of well fluid from the BOP Unit and other well control apparatus to the marine environment.

A BOP encapsulation system having an open condition permitting drilling activity and having a closed condition establishing sealed encapsulation of the BOP stack 30, is shown generally at 36 at the lower portion of FIG. 1 and in FIGS. 2-6. The BOP encapsulation system is mounted for opening and closing movement relative to the base plate or drilling template 34 and about a ball joint 35 that typically connects the BOP 30 with the riser conduit 26. When completely closed and positively sealed, the encapsulation system 36 establishes a pair of dual and concentric sealed, pressure containing domes that surround and encapsulate the BOP stack 30, establish positive sealing with the riser pipe 26. The concentric domes serve to contain and secure any leakage of liquid or gas constituents and the consequent pressure of any fluid that may be leaking from the BOP or the production risers that transport petroleum constituents to a suitable receiving system for fluid or gas storage and handling. The BOP encapsulation system 36 incorporates a number of seals, each of which is pressure activated, such that an increase of pressure within the containment domes results in a like enhancement of the sealing capability of the seals. This pressure responsive seal enhancement feature will be discussed in greater detail below.

Referring to FIGS. 1-6, the BOP stack encapsulation system 36 comprises a primary encapsulation dome, shown generally at 38 and a secondary encapsulation dome, shown generally at 40, each being defined by a pair of substantially quarter spherical structures that are linearly moveable relative to a BOP stack 30 and riser pipe 26, between open or retracted positions and closed and sealed positions. The primary encapsulation dome 38 is defined by a pair of quarter spherical dome sections 42 and 44 which are each supported during linear movement by the base plate or drilling template 34. The quarter spherical dome sections 42 and 44 each have bottom edge seals, such as shown at 43 in FIG. 4, that establish pressure enhanced sealing between the dome sections and the upper planar surface 34 of the drilling template. In the alternative, the quarter dome sections 42 and 44 of the primary encapsulation dome may have upper seal members 54 and 55, as shown in FIG. 2, that are fixed to the spherical dome walls, as shown in FIG. 5, and which are arranged with seals to engage and establish positive sealing with the BOP stack 30 when the primary dome sections 42 and 44 of the primary encapsulation dome are closed and sealed. The quarter spherical sections of the primary encapsulation dome 38 are moved in opening and closing directions by a plurality of hydraulic actuators 48 that are arranged to apply traction force to move the dome sections of the primary encapsulation dome together for closing and sealing as shown in FIG. 1, and to apply a pushing force to separate the dome sections and move them to predetermined open positions, as shown in FIG. 5.

A primary sealing skirt 50 is mounted to the riser member 26 and defines a number of downwardly and outwardly extending sealing fingers 52 that are positioned for engagement and sealing with respect to top sealing elements 54 and 55 that are present at the upper central portions of each of the quarter dome members 42 and 44. The top sealing elements 54 and 55 have an undulating or wave-like circumferential configuration, thus establishing positive sealing with the downwardly and outwardly extending sealing fingers 52 of the sealing skirt 50. When the primary dome sections 42 and 44 are closed, as shown in FIG. 5, the sealing fingers 52 and the top sealing elements 54 and 55 establish positive pressure responsive sealing, such that an increase of pressure within the primary encapsulation dome will result in a corresponding increased or enhanced sealing capability. The quarter dome sections 42 and 44, as shown in FIG. 2, also define curved sealing edges 56 and 58 that also have undulating or wave-like seal geometry, according to FIGS. 10 and 11, and also establish pressure enhanced sealing when the curved sealing edges have been moved into sealing engagement.

The secondary encapsulation dome 40 is also defined by a pair of quarter spherical dome sections 60 and 62 which are each mounted for linear movement along spaced guide tracks or rails 64 and 66. The dome sections 60 and 62 are moved during opening and closing by rotary drive rollers 68 or other movable supports and are independently moved by a suitable motive mechanism 70 such as a hydraulic drive system, pneumatic actuator system, and electric motor drive system or the like. The secondary encapsulation dome 40 may be closed after, simultaneously with, or in desired sequence with closing of the primary encapsulation dome 38. The secondary dome sections 60 and 62 also define upper seal members 72 and 74, that are preferably of wave-like form, and which are positioned for sealing engagement with a downwardly and outwardly oriented secondary sealing skirt 76 that is affixed to the riser pipe 26. The secondary sealing skirt 76 defines an undulating seal configuration of wave-like circumferential form that is defined by a plurality of sealing fingers 78. The secondary dome sections 60 and 62 also define curved edge or face seals 80 and 82 that are also of undulating or wave-like geometrical form, similar or identical to the face or edge seal configuration that is shown in FIGS. 10 and 11. The pressure responsive seals, throughout the primary and secondary encapsulation domes may be composed of any of a number of suitable rubber or rubber-like materials, such as Nitrite, or may be composed of any of a number of suitable polymer materials as desired. The seal members may be mounted within seal grooves or backed up by metal seal support structures, to ensure against pressure displacement of the seals. Bottom dome edge seals 81 are mounted to the facing edges of each of the secondary encapsulation domes, as shown in FIG. 5. When the secondary encapsulation domes are moved into sealing engagement, the bottom edge seals will establish pressure responsive sealing engagement with one another to ensure against pressure leakage from the secondary encapsulation dome. Bottom circumferential seals 83 and 85 are mounted to the lower, circumferential edges of each of the sections 42 and 44 of the secondary encapsulation dome 40 and establish pressure responsive sealing with the base plate or drilling template 32 when the secondary dome sections have been moved to the closed and sealed positions thereof, as shown in FIG. 6.

The partially hemispherical closure members 60 and 62 of the secondary BOP encapsulation dome 40 are each of a size to enclose the BOP stack 30, including the ram type BOP devices and the annular or spherical BOP unit 31, and to enclose and establish a substantially concentric, spaced relation with the outer surface of the primary encapsulation dome 38. The secondary encapsulation dome essentially functions as a back-up encapsulator, with the space or chamber 84, between the primary and secondary encapsulation domes, arranged to capture and control any fluid that might leak from the primary encapsulation dome. The enclosure that is defined by the secondary encapsulation dome also has a pressure containing capability due to the pressure enhanced edge or face seals 86 and 88 thereof. Any fluid pressure leakage from the primary encapsulation dome will enter the space 84 between the primary and secondary encapsulation domes and will be effectively contained by the secondary encapsulation dome and thus will be prevented from contaminating the marine environment. The primary encapsulation dome is provided with a valve controlled bleed fitting 90 that permits captured fluid, leaked from the BOP stack 30 or the wellhead apparatus, to be bled from the primary encapsulation dome and conducted via a conduit system, not shown, to a suitable receiver, such as fluid recovery vessel at the surface of the seal or to a safety line that is connected with a production flow line. Likewise, the secondary encapsulation dome is provided with a valve controlled bleed fitting 92 through which any collected fluid or gas pressure within the space 84 can be bled to a suitable collector line to a suitable receiver. The control valves of the bleed fittings 90 and 92 of the primary and secondary encapsulation domes can be controlled from a control unit located on the drilling or production platform, or can be controlled from a nearby surface vessel, helicopter, airplane or from a shore based control system as desired.

In the event of a condition of leakage of pressurized gas, liquid, or any other well fluid from the BOP stack 30, it is appropriate that the quarter sections of the primary encapsulation dome are enabled to become completely closed and sealed prior to a substantial build-up of pressure within the dome. To accomplish this feature, the quarter sections 42 and 44 of the primary encapsulation dome 38 are provided with a plurality of pressure escape gate mechanisms shown generally at 94, and which are shown in greater detail in FIGS. 7 and 8.

The wall structure 96 of the primary encapsulation dome defines a plurality of vent ports 98 each having an inner sealing surface 100 located circumferentially about the ports. Each of the escape gate valve plate members also defines a curved concave plate surface 101 which is oriented to face inwardly, toward the direction of pressure within the primary encapsulation dome. Thus, the plate valve members have less thickness at the central portion thereof, so that any pressure responsive flexing thereof will tend to enhance their sealing capability with the sealing surfaces 100 about the ports 98. For each escape gate, a valve plate member 102 defines a generally planar sealing surface 104 that is supported by a lever member 106 that extends from an actuator member 108, such as a hydraulic actuator.

Normally, the escape gate valve plate member 102 is positioned in a retracted, non-sealing relationship with respect to the sealing surface 100 around the escape port so that fluid pressure leakage into the primary encapsulation dome will be bled through the ports 98, thus minimizing the pressure build-up within the primary encapsulation dome. Fluid pressure build-up will not prevent the dome sections 42 and 44 from being moved to their closed and sealed positions by the hydraulic actuation system 48. The hydraulic arms 48 will thus impart sufficient traction force to each of the dome sections 42 and 44 to draw the primary dome sections together, even when leakage is occurring, so that the seals of the primary dome sections will establish initial sealing as the dome sections are moved into engagement. This feature permits the arms to be selectively actuated by an actuator system responsive to pressure detection, thus moving the dome sections 42 and 44 to their closed positions, with the face seals 56 and 58 engaged and establishing initial sealing.

As the dome sections are closed, the upper seal geometry thereof establishes initial sealing with the seal geometry 52 of the primary seal skirt 50 and the edge or face sealing members become initially sealed. After this initial sealing has been accomplished, the various escape gate mechanisms may be actuated concurrently or sequentially, thereby permitting pressure within the primary encapsulation dome to build up in controlled manner. This feature ensures that the dome sections are not required to close against rapidly increasing pressure, but are permitted to become closed and initially sealed. Thereafter, fluid pressure acts on the seal configuration, as shown in FIGS. 9-11, and causes the sealing capability of the seals to increase in response to an increase in pressure within the primary encapsulation dome.

As shown in the top or plan view of FIG. 9, the dome sections, whether of the primary or secondary encapsulation dome, are indicated by reference numbers 110 and 112. The wave-like sealing faces 114 and 116 are moved into sealing engagement by application of traction force to the primary dome sections 42 and 44 via the traction forces of the hydraulic actuators 48. The seal sections have a curved pressure responsive configuration as shown at 118 and 120. Fluid pressure, acting on these curved surfaces, which have greater surface area than the surface area of the face seals, generates significant resultant force, urging the face sealing members into tighter sealing engagement as the escape gates become closed and pressure within the primary encapsulation dome increases. When a predetermined pressure has been established within the primary encapsulation dome, the bleed valve 90 will be opened, permitting contained pressurized fluid to be bled to a suitable receiver, as explained above. As pressure build-up occurs within the primary encapsulation dome, the various seal members, each being pressure enhanced, increase their consequent sealing integrity in proportion to the pressure increase within the primary encapsulation dome 38.

After the primary dome sections have been moved to their completely closed positions and initial sealing has been accomplished and the escape gates have been closed, in absence of leaked pressure, the space 84 between the primary and secondary encapsulation domes, will typically be balanced with the hydrostatic pressure of the seawater at the depth of the BOP. At this point, the valve closure plates of the escape gates will be closed in a manner that will permit gradual pressure increase within the space between the primary encapsulation dome and the BOP stack. If desired, the escape gate mechanisms may be closed sequentially to permit sufficiently gradual pressure increase within the inner encapsulating enclosure to ensure against the occurrence of damaging shock to its metal structure. The primary encapsulation dome is designed to accommodate the pressure conditions that will be expected, for example 15,000 psi or more in the case of deep wells. Upon well blow-out, or detected pressure conditions threatening blow-out, the pressure containment system of the present invention has been designed to encapsulate the basic offshore blow-out preventive systems and prevent massive leakage of oil/gas fluids from the BOP stack 30 to the surrounding marine environment.

Basic Operation:

The BOP encapsulation system allows interfitting sections of a primary encapsulation dome 38 to be pulled over the existing BOP stack 30 and to close around and establish effective pressure responsive sealing with the riser 26 to which has been attached a pressure ring sealing Skirt 50 that matches the geometric configuration of the sealing elements 54 of the sections of the primary encapsulation dome 38. Upon closing, the pressure, once it exceeds the hydrostatic pressure of the seawater at BOP depth, will be contained by closing the sealable pressure escape gates 98. This slow closing allows the pressure to build up in controlled manner, without causing excessive stress of the components of the primary encapsulation dome 38. As pressure increase, and the hydraulic pulling arms 48 have secured the seal contact of the primary dome, the seals 56 and 58 that are designed to increase sealing capability as pressure increases the primary dome will be situated such that the BOP stack 30 and riser 26 are now totally encapsulated. While the sealable pressure escape gates 98 are slowly closing, the secondary encapsulation dome 40, as a back-up safety device, will start closing over the primary encapsulation dome, being moved forwardly along the installed rails 64 and 66 by means of power driven drive wheels 68. The sealing elements of the secondary dome, the skirt seal 76 around the circumference of the riser 26 and the face seals 80 and 82 are also pressure responsive and increase their sealing capability in response to increase of pressure in the space 84 between the primary and secondary encapsulation domes. Build up of pressure within both domes can be bled off by controlling the valve controlled fittings 90 and 92 located on the primary encapsulation dome 38 and on the secondary encapsulation dome 40.

The BOP encapsulation system 36 can be controlled by signals transmitted from surface or can be triggered by either pressure variables or detection of oil and gas. All controls that accomplish closing and sealing of the encapsulation system can also be programmed such that any movement and activity is systematically executed while triggered by pre-set pressure variations or variations in chemical environment. Overriding of the operational control system is controlled from surface or by remote control from either ship, airplane, helicopter, or from a shore based control facility.

Three Stages of Operation.

A. Open Position.

A typical riser 26 connects the standard blow out preventer stack 30 from the sea bottom to the surface. This set-up includes a slip joint (not shown) to compensate for the wave action at the sea surface. sealing skirts 50 and 76 are attached to the riser, they form seals between the primary and secondary encapsulation domes and the riser upon closing of the dome sections of the encapsulator.

In normal open position the quarter spherical dome sections 42 and 44 of the primary encapsulation dome 38 are positioned in spaced relation and are located at opposite sides of the blow-out preventer stack 30. The two sections of the primary encapsulation dome 38 are each provided with a number of closeable escape gates 98 and, for sealing, are also provided with a skirt sealing section 54 and face sealing sections 80 and 82. The primary encapsulation dome sections are connected with several hydraulically activated sealing rods 48 that apply traction force to accomplish movement of the primary dome sections toward one another and into sealing engagement with one another. One or more valve controlled pressure relief conduits 90 are connected with the primary encapsulation dome and serve to permit pressure within the primary dome to be controllably bled away and conducted to a suitable receiver.

The secondary encapsulation dome 40 serves a back-up system and for additional safety. In its open position, the two sections of the secondary encapsulation dome are located on opposite sides of the BOP stack and on opposite sides of the primary encapsulation dome 38, essentially as shown in FIGS. 3-5. The sections of the secondary encapsulation dome are moveable along guide rails 64 and 66 and is movable by a rotary drive mechanism having drive rollers or wheels 68 that are energized by a hydraulic, electrical or pneumatic power and control system 70. The guide rails may be in the form of toothed rack type rails, with the teeth of the rails being engaged by corresponding drive teeth of the drive wheels 68. The secondary dome caries similar closing seals, across the riser it uses a skirt type seal mechanism 76 which is engaged by self-sealing positive sealing elements that are provided on the secondary dome sections 60 and 62.

B. Intermediate Closing Position.

Upon receiving a signal from the drilling platform, remote control, shore base or from a chemically activated control system, the hydraulic closing arms 48 will retract and pull both sections 42 and 44 of the primary encapsulation dome 38, together until the skirt seals 50, 72 and 74 and the face seals 56 and 58 become engaged and establish initial sealing. At this time the pressure escape gates 98 remain open for pressure venting until the primary encapsulation dome of the encapsulation system is completely closed and sealed. The pressure escape gates 98 are hydraulically controlled and fully sealable as described above in connection with FIGS. 7 and 8.

With the primary encapsulation dome 38 completely closed, the dome encapsulates the BOP stack 30 and establishes pressure enhanced sealing about the riser 26 and with the sealable pressure escape gates 94 closed, the escape of fluids is controlled and any build-up of pressure, above a predetermined pressure level, can be bled off through the valve controlled bleed fitting 90 to a suitable receptacle, such as a surface vessel or flow line.

C. Secondary Dome Sealing and Back-Up Safety.

In order to ensure total sealing and control of pressurized fluid and gas escape, the secondary encapsulation dome sections 60 and 62 are moveable from an open position to a closed and sealed condition to encapsulate the closed and sealed primary encapsulation dome set-up. The secondary dome sections 50 and 62 are moved by a rotary drive wheel 68 attached to the rails (6) and allows full closure of the dome.

Sealing of the secondary encapsulation dome 40 is achieved by the use of positive sealing elements in the second riser skirt seal mechanism 72, 74, 76 and 78 and in the sealing elements that are situated on the dome face seal section 80, the bottom dome seal section 81 and circumferential sealing section 83 and 85 between the base plate or drilling template 32 and the secondary dome body 40.

Salient Features

1. Nitrite/Rubber positive closing/sealing elements . . . . Sealing increases with pressure, increasing . . . based on an undulating or wave-like seal geometry with concave facing. Normal sealing occurs when closing system hydraulically or pneumatically or mechanically.
2. Sealing skirt, closes around the main riser pipe which is fitted with the similar pattern skirt to fit 100%.
3. Hydraulic traction pulling system is employed to move both spherical sections to their closed and sealed positions.
4. Sealable pressure escape gates; these gates are normally open and will allow the closing dome to move over the BOP stack and establish sealing with the riser. After the dome sections have been moved to their closed and sealed positions, the pressure escape gates will be systematically closed by appropriate control signals or by a timer.
5. Circulating and pressure drainage piping controllable from surface or from a remote location. Connections from this outlet can be made to any conventional fluid receptacle, flow line or flaring system.
6. Lower riding seal, positive sealing system that increases sealing with increasing pressure.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for containing well fluid leakage from a subsea well having a blow-out preventer system (BOP) connected with a riser conduit and being located at the sea bed, comprising:

positioning primary and secondary encapsulation domes near said BOP, each of said primary and secondary encapsulation domes having a pair of quarter dome sections being positioned on opposite sides of the BOP and being moveable linearly and substantially horizontally between open positions with said dome sections substantially horizontally spaced from one another with the BOP between them and closed positions with said quarter dome sections moved linearly and substantially horizontally into contact with one another and establishing sealed engagement with one another, said primary encapsulation dome, when closed, encapsulating the BOP and establishing sealing with said riser conduit, and said secondary encapsulation dome, when closed, encapsulating said primary encapsulation dome and establishing sealing with said riser conduit;

maintaining said primary and secondary quarter encapsulation dome sections in substantially horizontally spaced open positions during normal well drilling and production activity; and moving said primary and secondary quarter encapsulation dome sections from said substantially horizontally spaced open positions to said closed positions responsive to detection of a predetermined abnormal well condition.

2. The method of claim 1, comprising:

when a predetermined abnormal well condition is sensed, first moving said quarter encapsulation dome sections of said primary encapsulation dome substantially horizontally to said closed positions, establishing sealing between said primary quarter encapsulation dome sections and establishing sealing of said quarter primary encapsulation dome sections with the riser conduit;

after closing and sealing of said primary quarter encapsulation dome sections, moving said quarter encapsulation dome sections of said secondary encapsulation dome substantially horizontally from said open positions to said closed positions, encapsulating said primary encapsulation dome therein, and establishing sealing of said secondary quarter dome sections with one another and with said riser conduit.

3. The method of claim 1, wherein a valve controlled escape gate is present in said primary encapsulation dome, is normally open to permit closure and sealing of said primary encapsulation dome and is closed after closure and sealing of said primary encapsulation dome for containment of well pressure and fluid leakage, said method comprising:

with said valve controlled escape gate open, moving said primary quarter encapsulation dome sections of said primary encapsulation dome to said closed positions;

accomplishing sealing of said primary quarter encapsulation dome sections with one another and with the riser conduit extending upwardly from the BOP; and closing said escape gate for containment of well pressure and fluid leaked from said BOP.

4. The method of claim 3, wherein a base plate is located on the sea bottom, a power actuator is connected with said primary quarter encapsulation dome sections for substantially horizontal opening and closing movement thereof and pressure enhanced sealing elements are provided on said primary quarter encapsulation dome sections and develop enhanced sealing in response to increase of pressure within said primary encapsulation dome, said method comprising:

at said closed positions of said primary quarter encapsulation dome sections, establishing pressure responsive sealing between said primary quarter encapsulation dome sections, between said primary encapsulation dome and said riser and between said primary encapsulation dome and said base plate; and increasing mechanical sealing engagement of said pressure enhanced sealing elements in proportion to the increase of pressure within said primary encapsulation dome.

5. The method of claim 1, comprising:

maintaining said quarter encapsulating dome sections of said secondary encapsulation dome open during normal well activity; and upon detection of a predetermined abnormal well condition, after closing and sealing of said primary encapsulation dome, moving said secondary quarter dome sections of the secondary encapsulation dome substantially horizontally to said closed positions thereof and encapsulating and establishing a substantially concentric spaced relation of said secondary encapsulation dome with said primary encapsulation dome.

6. The method of claim 5, wherein a base plate is positioned at the sea bed and powered rotary drive members are mounted to said secondary quarter encapsulation dome sections of said secondary encapsulation dome and establish driving relation with said base plate, and sealing members are mounted to said secondary quarter encapsulation dome sections and establish sealing engagement with one another, with said base plate and with said riser conduit when said secondary quarter dome sections have been moved into engagement, said method comprising:

activating said powered rotary drive members and selectively opening or closing said secondary encapsulation dome relative to said primary encapsulation dome by selective substantially horizontal movement of said secondary quarter encapsulation dome sections along said base plate by said powered rotary drive members.

7. Apparatus for encapsulating a subsea BOP having a riser member extending upwardly from the BOP and for containing any leaked well fluid that is detected or indicated, comprising:

a base plate positioned at the sea bed below the BOP;

a primary encapsulation dome having a pair of primary quarter dome sections each being linearly moveable along said base plate between an open position with said primary quarter dome sections spaced from one another with the BOP between said primary quarter dome sections and a closed position with said primary quarter dome sections having pressure containing sealing engagement with one another and encapsulating said BOP and establishing sealing with the riser member;

a first power actuated system having driving connection with said primary quarter dome sections and being selectively operative for moving said primary quarter dome sections linearly to said open position and to said closed position;

a secondary encapsulation dome having a pair of secondary quarter dome sections each being linearly moveable between an open position with said secondary quarter dome sections spaced from one another and a closed position with said secondary quarter dome sections being engaged with one another and encapsulating said primary encapsulation dome and establishing sealing with the riser member;

a second power actuated system having driving connection with said secondary quarter dome sections and being operative for selectively moving said secondary quarter dome sections linearly to said open position and to said closed position; and pressure responsive seal members being supported by said primary and secondary quarter dome sections and establishing sealing of said quarter dome sections of said primary and secondary encapsulation domes with one another, establishing sealing of said primary and secondary encapsulation domes with the riser member and establishing sealing of said primary and secondary encapsulation domes with said base plate.

8. The apparatus of claim 7, comprising:

said first power actuator system being selectively operative to move said primary quarter dome sections to said closed positions thereof and to move said primary quarter dome sections to said open positions; and said second power actuator system being selectively operative to move said secondary quarter dome sections to said closed positions thereof and to move said secondary quarter dome sections to said open positions thereof.

9. The apparatus of claim 7, comprising:

said first power actuator system being a hydraulic actuator system applying traction force to said primary quarter dome sections for closing movement thereof and applying a pushing force to said primary quarter dome sections for opening movement thereof.

10. The apparatus of claim 7, comprising:

a pressure escape port being defined in one of said primary quarter dome sections;

a pressure escape gate being mounted to said primary quarter dome section and being moveable between an open position permitting the escape of pressure from said pressure escape port and a closed position sealing said pressure escape port and preventing the escape of pressure from said pressure escape port; and a gate actuator mechanism selectively moving said pressure escape gate to said open position and to said closed position.

11. The apparatus of claim 7, comprising:

rail members being fixed to said base plate;

said secondary quarter dome sections being linearly moveable substantially horizontally along said rail members to said closed position and to said open position; and said first and second power actuator systems being activated responsive to detection of BOP leakage or a predetermined abnormal well condition for initially closing said primary encapsulation dome about said BOP and subsequently closing said secondary encapsulation dome about said primary encapsulation dome.

12. The apparatus of claim 7, comprising:

pressure energized seal members establishing sealing between said primary quarter dome sections, establishing sealing between said secondary quarter dome sections, sealing said primary and secondary quarter dome sections with said riser member and establishing sealing of said primary and secondary quarter dome sections with said base plate, said pressure energized seal members having sealing capability that is enhanced in proportion to increase of pressure within said primary encapsulation dome and within said secondary encapsulation dome.

13. The apparatus of claim 12, comprising:

said pressure energized seal members having an undulating geometric form establish a greater area differential that is exposed to contained pressure within said primary and secondary quarter encapsulation domes as compared with the seal area that is in sealing engagement.

14. Apparatus for encapsulating a subsea BOP having a riser member extending upwardly from the BOP and for containing any leaked well fluid that is detected or indicated, comprising:

a base plate positioned generally horizontally at the sea bed below the BOP and having a pair of generally parallel guide rails affixed thereto;

a primary encapsulation dome having a pair of primary quarter dome sections each being linearly moveable substantially horizontally between an open position with said primary quarter dome sections engaging said generally parallel guide rails and being spaced from one another with the BOP located between said primary quarter dome sections and a closed position with said primary quarter dome sections having sealing engagement with one another and encapsulating said BOP and establishing sealing with the riser member;

a secondary encapsulation dome having a pair of secondary quarter dome sections each being linearly moveable substantially horizontally between an open position with said secondary quarter dome sections engaging said generally parallel guide rails and being spaced from one another and a closed position with said secondary quarter dome sections being engaged with one another and encapsulating said primary encapsulation dome and establishing sealing with the riser member and with said base plate;

a first power actuator system having power transmitting connection with said primary quarter dome sections and being selectively operative to move said primary quarter dome sections linearly and substantially horizontally to said open position and to said closed position;

a second power actuator system having power transmitting connection with said secondary quarter dome sections and being selectively operative for moving said secondary quarter dome sections linearly and substantially horizontally to said open position and to said closed position; and pressure responsive seal members being supported by said primary and secondary quarter dome sections and establishing sealing of said quarter dome sections of said primary and secondary encapsulation domes with one another and with said riser member and establishing sealing of said primary and secondary encapsulation domes with said base plate.

15. The apparatus of claim 14, comprising:

said first power actuator mechanism being a hydraulic actuator system applying traction force to said primary dome sections for substantially horizontal closing movement thereof and applying a pushing force to said primary dome sections for substantially horizontal opening movement thereof; and said second power actuator system having driving engagement with said secondary quarter dome sections and moving said secondary quarter dome sections linearly and substantially horizontally to said closed positions encapsulating said primary encapsulation dome and moving said secondary quarter dome sections linearly and substantially horizontally to said open positions thereof.

16. The apparatus of claim 14, comprising:

said second power actuator system having driving engagement with said secondary quarter dome sections and moving said secondary quarter dome sections linearly and substantially horizontally to said closed positions encapsulating said primary encapsulation dome and moving said secondary quarter dome sections linearly and substantially horizontally to said open positions thereof;

a pressure escape port being defined in one of said primary dome sections and permitting complete closure of said primary quarter dome sections during conditions of BOP leakage;

a pressure escape gate being mounted to one of said primary quarter dome sections and being moveable between an open position permitting the escape of pressure from said pressure escape port permitting complete closure and sealing of said primary quarter dome sections and a closed position sealing said pressure escape port and containing leaked well fluid and pressure within said primary encapsulation dome; and a gate actuator mechanism selectively moving said pressure escape gate to said open position and to said closed position.

17. The apparatus of claim 16, comprising:

valve controlled pressure bleed fittings being mounted to said primary encapsulation dome and to said secondary encapsulation dome and permitting selective bleeding of pressure therefrom.

* * * * *